US006264808B1

(12) United States Patent
Marttila

(10) Patent No.: US 6,264,808 B1
(45) Date of Patent: Jul. 24, 2001

(54) ELECTRODE FOR ELECTROLYTIC REFINING OR ELECTROWINNING AND METHOD FOR PRODUCING THE SAME

(75) Inventor: Tom Marttila, Kirkkonummi (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/509,670

(22) PCT Filed: Sep. 24, 1998

(86) PCT No.: PCT/FI98/00756

§ 371 Date: Mar. 31, 2000

§ 102(e) Date: Mar. 31, 2000

(87) PCT Pub. No.: WO99/18264

PCT Pub. Date: Apr. 15, 1999

(30) Foreign Application Priority Data

Oct. 6, 1997 (FI) ..... 973888

(51) Int. Cl.[7] ..... C25B 11/00
(52) U.S. Cl. ..... 204/280; 204/281; 29/746
(58) Field of Search ..... 204/280, 281; 264/176.1, 177.1; 29/746

(56) References Cited

U.S. PATENT DOCUMENTS 4,670,124 * 6/1987 Bartsch et al. ..... 204/281
4,776,928 * 10/1988 Perlich ..... 204/281
4,950,375 * 8/1990 Leger ..... 204/281

* cited by examiner

*Primary Examiner*—Bruce F. Bell
(74) *Attorney, Agent, or Firm*—Smith-Hill and Bedell

(57) ABSTRACT

The invention relates to an electrode for electrolytic refining or electrowinning, said electrode (1, 21, 41) being provided with a hanger bar (3, 23, 43) attached to the edge of one plate-like mother plate, and the edges (4, 5, 6; 24, 30, 31; 44, 49, 50) of said electrode, apart from the edge to which the hanger bar is fastened, being protected with an edge strip (11, 12, 13; 29, 32, 33; 48, 51, 52) made of some insulating material, in which electrode at least part of the edge strips is at least partly placed in a groove (7, 25, 45) made in the electrode edge. According to the invention, at least in one electrode edge (4, 5, 6; 24, 30, 31; 44, 49, 50), there is formed a groove (7, 25, 45) for the electrode edge strip (11, 12, 13; 29, 32, 33; 48, 51, 52) made of some insulating material; the front end of said groove, located at the electrode edge (4, 5, 6; 24, 30 31; 44, 49, 50), being essentially equal in width with the rear end (10, 28, 53) of the groove placed inside the electrode. The invention also relates to a method for manufacturing the electrode (1, 21, 41).

12 Claims, 2 Drawing Sheets

ELECTRODE FOR ELECTROLYTIC REFINING OR ELECTROWINNING AND METHOD FOR PRODUCING THE SAME

The present invention relates to an electrode used in electrolytic refining or electrowinning, i.e. a cathode, provided at least on one side with an edge strip made of some insulating material in order to prevent the growing together of the deposits created in electrolytic refining or electrowinning. The invention also relates to a method for producing the electrode.

BACKGROUND OF THE INVENTION

In electrolytic refining or electrowinning, which is used as a sub-process in the production of metals, such as copper, nickel and zinc, the cathode electrode employed at present is commonly a mother plate made of stainless steel, and the metal to be refined is precipitated on both sides of said mother plate. If the mother plate edges are not protected with an edge strip made of some insulating material, the deposits created in the refining or electrowinning process on both sides of the mother plate will grow together. Such edge strips and their use is described for example in the EP patent application 454,056 and in the FI patent application 955,919.

The edge strips used in the mother plate are generally installed on the mother plate surface, in which case the surface-installed edge strips are susceptible to damage when the deposits are being removed. Particularly the bottom edge strip, located on the opposite side with respect to the fastening edge of the hanger bar of the mother plate, is prone to damage, because the deposits are usually removed from the hanger bar direction towards the bottom edge strip. Although the bottom edge strip were not damaged during deposit removal, the edge strip installed on the mother plate surface gathers impurities that weaken the purity of the deposit created on the mother plate surface.

In order to obviate the drawbacks caused by edge strips installed on the mother plate surface, the FI patent application 863,244 introduces an edge strip which is installed in a dovetail groove, so that part of the edge strip is placed in said groove in order to support the external part of said groove.

The edge strip is formed of a polymer film, folded in its longitudinal direction; a stainless steel wire is placed in the fold, and the overlapping film halves, located on top of each other, are joined in a watertight fashion. The edge strip formed in said fashion is drawn in, together with the included wire, starting from the bottom end of the grooved cathode edge. Thus the edge strip is drawn over the topmost horizontal cathode edge, so that the overlapping part facilitates the replacing of a used edge strip at some later stage. By means of the stainless steel wire placed in the groove, the edge strip is protected from being protruded or drawn out of the wedge-shaped aperture during usage. However, the edge strip according to the FI patent application 863,244 is not suited to be realized as a uniform strip covering all three edges of the cathode plate, because the problems caused by the bottom corners of the cathode plate, left in between the vertical edge strips and the horizontal edge strip, are equally serious as with traditional external edge strips. Moreover, the structure of the edge strip is not necessarily suitable for ordinary cathode plate thicknesses, because for instance the use of stainless steel wire requires a given addition in the cathode plate thickness.

SUMMARY OF THE INVENTION

The object of the present invention is to obviate some of the drawbacks of the prior art and to realize an improved electrode for electrolytic refining or electrowinning, with lower production costs than the prior art electrodes, and a method for producing said electrode; the electrode edges, apart from the hanger bar fastening edge, are provided with edge strips in order to prevent the deposits created in electrolytic refining or electrowinning from growing over the edges, from one side of the electrode to the other, so that at least one of the edge strips is installed at least partly to an essentially straight-walled groove formed in the electrode edge. The essential novel features of the invention are apparent from the appended claims. According to the invention, in an electrode used in electrolytic refining or electrowinning—one edge of which electrode is provided or can be provided with a hanger bar—there is formed a groove at least in the edge opposite to the hanger bar, and the width of said groove is substantially equal at least at its front end located at the electrode edge and at the rear end placed inside the electrode. The desired groove width between said groove ends can vary depending on the target of usage of the electrode; in the area between the two ends, the groove can either have equal walls, or then it can be wider or narrower. If the groove has equal walls in the area between the two ends, the groove wall is essentially straight through the whole length of the groove and parallel to the electrode surface. If the groove is wider in the area between the two ends, this widening is achieved either in a curved or in a linear fashion. The widening of the groove is advantageously achieved so that the groove is at its widest substantially in the middle, with respect to the groove length. When the groove is narrower in the area between the two ends, the narrowing is advantageously achieved in similar fashion as the widening of the groove.

By means of the design of the groove formed in the electrode edge, it is advantageously secured that the edge strip stays in place inside the groove. The staying in place can be further improved, particularly when using a straight-walled groove, by pressing the groove edges together in the immediate vicinity of the electrode edge after the edge strip already is placed in the groove. Now the width of the groove formed in the electrode edge may in the front end become smaller than in the rear end, but even in this case the starting point is a groove with front and rear ends that are substantially equal in width.

According to the invention, the edge strip made of some insulating material is at least partly installed in the groove provided in the electrode edge so that the thickness of the edge strip is essentially not more than the thickness of the electrode. The edge strip thus prevents the growth of the deposit from one side of the electrode to another side so that the deposits created on the different sides cannot grow together over the electrode edge surface. At the same time, the edge strip does not, however, prevent possible impurities contained in the electrolyte from unrestrictedly flowing along the electrode surface.

The edge strip manufactured of some insulating material and installed, at least partly, in the groove made in the electrode edge is advantageously made by extruding the plastic material of the edge strip directly into the groove, in which case the desired shape for the edge strip is obtained simultaneously. The edge strip can also be shaped so that when manufacturing the edge, for example by machining or by extrusion, the edge strip is designed, at least as regards the part meant to be inserted in the groove provided in the electrode edge, to be essentially wedge-shaped.

When employing, according to the invention, an edge strip that is at least partly installed in a groove formed in the electrode edge, at least in the edge that is opposite to the electrode hanger bar, there can be achieved a substantially uninterrupted protection for all electrode edges, apart from the hanger bar fastening edge. In all three edges, there can now be used for instance ready-shaped wedge-like edge strips that are sawed in the desired measures. The edge strips are installed in the grooves formed in the electrode edges, and the groove edges are, when necessary, pressed together in order to ensure that the edge strip stays better in place in the groove. It is also possible to use, exclusively in the groove opposite to the electrode hanger bar, a ready-shaped, wedge-like edge strip to be installed in the groove made in the electrode edge, whereas the edges adjacent to the hanger bar are provided with edge strips external to the edge. Now it is most advantageous to first arrange the edge strip to be installed in the groove in the electrode edge in place, and thereafter, for example by means of extrusion, to form the edge strips external to the electrode edge on the adjacent sides, so that the external edge strips stick both to the electrode surface and to the edge strip placed in the groove. Thus the electrode corners can also be protected by edge strips. Moreover, it also is possible to manufacture and install edge strips made by extrusion for all three edges. Even in that case it is possible that only the edge strip opposite to the electrode hanger bar is placed in the groove formed in the electrode edge, and the remaining two edges adjacent to the hanger bar are provided with external, extruded edge strips. Extrusion can also be applied so that all three edge strips are placed in grooves provided in the electrode edges, in which case the edge strips can be manufactured in an essentially continuous extrusion process.

BRIEF DESCRIPTION OF THE DRAWINGS

The invention is explained in more detail with reference to the appended drawings, where.

DETAILED DESCRIPTION OF THE PREFERRED EMBODIMENTS

Figure 1:
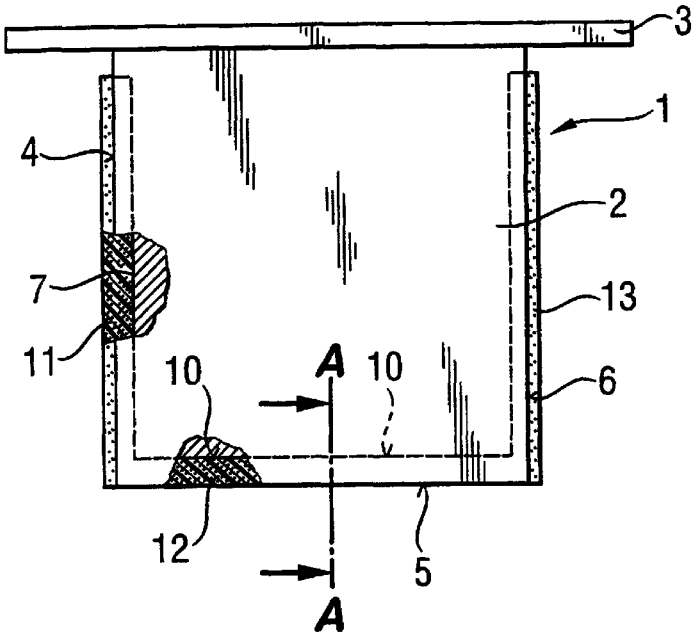
FIG. 1 is a side-view illustration of a preferred embodiment of the invention.
Figure 2:
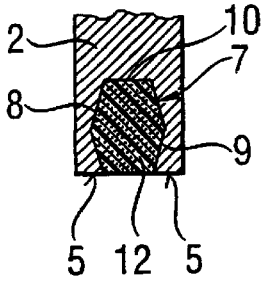
FIG. 2 shows the embodiment of FIG. 1, seen along the section A—A.

According to FIGS. 1 and 2, an electrode meant for electrolytic refining, i.e. a cathode 1, is composed of a planar cathode plate 2 and of a hanger bar 3 connected to said cathode plate 2. In the cathode edges 4, 5 and 6, which diverge from the edge where the hanger bar 3 is fastened, there is by machining formed a groove 7, which in the middle of the walls 8 and 9 is wider than in the rear end 10 and at the electrode edge 4, 5 and 6. In the groove 7, there are by means of continuous extrusion formed edge strips 11, 12 and 13 made of some insulating material. Thus the edge strips 11, 12 and 13 provide an uninterrupted edge protection for the cathode 1.

Figure 3:
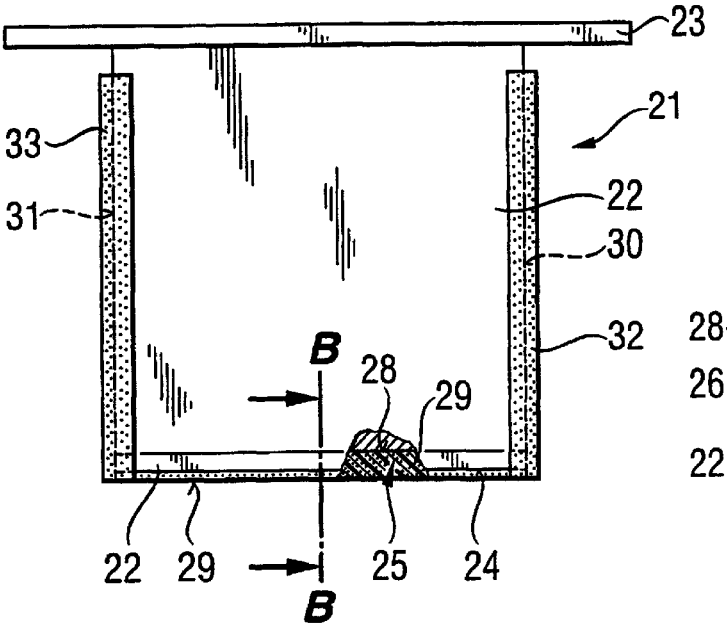
FIG. 3 is a side-view illustration of another preferred embodiment of the invention.
Figure 4:
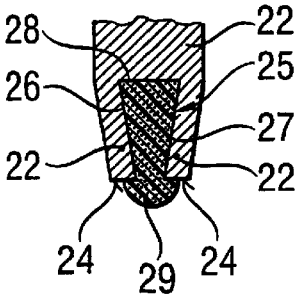
FIG. 4 shows the embodiment of FIG. 3, seen along the section B—B.

In FIGS. 3 and 4, in the edge 24 opposite to the hanger bar 23 of the cathode plate 22 of the cathode 21, there is formed a groove 25, the wails 26 and 27 of said groove being essentially parallel to the surface of the cathode 21 and hence essentially equal up to the rear end 28 of the groove. In the groove 25, there is placed a wedge-like edge strip 29 made of some insulating material, said edge strip 29 being compressed against the cathode plate 22 by pressing the cathode plate 22 from outside, essentially at the groove 25. On the other hand, the edges 30 and 31 of the cathode plate 22, adjacent to the hanger bar 23, are provided with edge strips 32 and 33 which are connected to the surface of the cathode plate 22. In relation to each other, the edge strips 29, 32 and 33 are shaped so that the edge strips 29, 32 and 33 together form a substantially uninterrupted edge protection.

Figure 5:
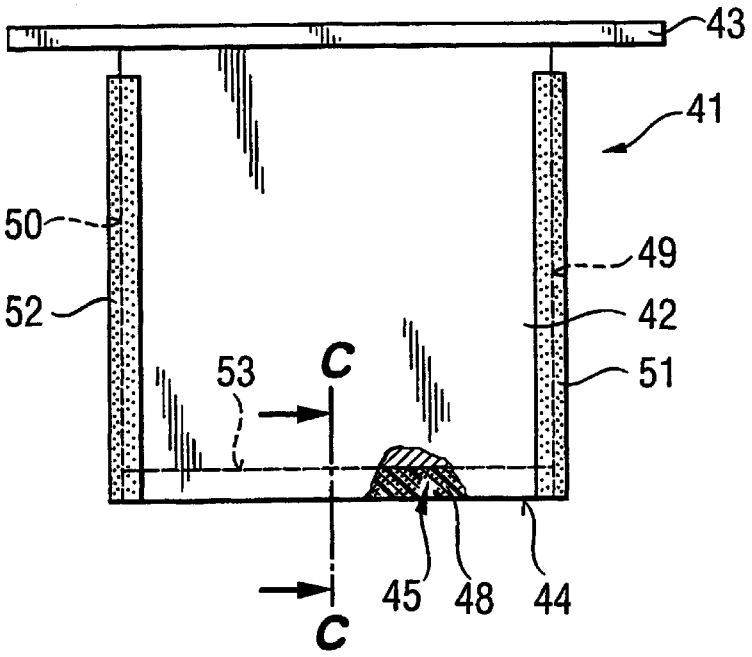
FIG. 5 is a side-view illustration of a third preferred embodiment of the invention.
Figure 6:
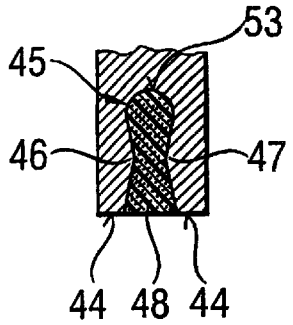
FIG. 6 shows the embodiment of FIG. 5, seen along the section C—C.

In FIGS. 5 and 6, in the edge 44 opposite to the hanger bar 43 of the cathode plate 42 of the cathode 41, there is formed a groove 45, the walls 46 and 47 of said groove being in the middle nearer to each other, so that in the middle the groove 45 is narrower than in the rear end 53 and at the edge 44. In the groove 45 there is installed an edge strip 48 having the same profile as the groove. The edges 49 and 50, adjacent to the hanger bar 43, are in FIGS. 5 and 6 protected by external edge strips 51 and 52, but when desired, the edges 49 and 50 can also be protected by edge strips located in the groove formed in the edge.

What is claimed is:

1. An electrode for electrolytic refining or electrowinning, said electrode (1, 21, 41) being provided with a hanger bar (3, 23, 43) attached to the edge of one plate form mother plate, and the edges (4, 5, 6; 24, 30, 31; 44, 49, 50) of said electrode, apart from the edge to which the hanger bar is fastened, being protected with an edge strip (11, 12, 13; 29, 32, 33; 48, 51, 52) made of some insulating material, in which electrode at least part of the edge strips is at least partly placed in a groove (7, 25, 45) made in the electrode edge, characterized in that at least in one electrode edge (4, 5, 6; 24, 30, 31; 44, 49, 50), there is formed a groove (7, 25, 45) to be filled by means of extrusion with the electrode edge strip (11, 12, 13; 29, 32, 33; 48, 51, 52) made of some insulating material, the front end of said groove, located at the electrode edge (4, 5, 6; 24, 30, 31; 44, 49, 50), being essentially equal in width with the rear end (10, 28, 53) of the groove placed inside the electrode.

2. An electrode according to claim 1, characterized in that at least the edge (5, 24, 44) opposite to the electrode hanger bar is provided with a groove (7, 25, 45) for the edge strip.

3. An electrode according to claim 1, characterized in that both the edge (5, 24, 44) opposite to the hanger bar and the edges (4, 6; 32, 33; 49, 50) adjacent to the electrode hanger bar are provided with a groove (7, 25, 45) meant for the edge strip.

4. An electrode according to claim 1, characterized in that the width of the groove (7, 25, 45) made in the electrode edge has equal walls to the part located in between the groove ends (4, 5, 6; 10), (24, 30, 31; 28) and (44, 40, 50; 53).

5. An electrode according to claim 1, characterized in that the groove (7, 25, 45) made in the electrode edge is wider in the area located in between the groove ends (4, 5, 6; 10), (24, 30, 31; 28) and (44, 49, 50; 53).

6. An electrode according to claim 1, characterized in that the groove (7, 25, 45) made in the electrode edge is narrower in the area located in between the groove ends (4, 5, 6; 10), (24, 30, 31; 28) and (44, 49, 50; 53).

7. A method for producing the electrode according to claim 1, characterized in that at least in the groove (7, 25, 45) made in the edge (5, 24, 44) opposite to the electrode hanger bar, there is formed by means of extrusion an edge strip (12, 29, 48) to be placed at least partly in said groove.

8. A method according to claim 7, characterized in that both in the edges (4, 6; 30, 31; 49, 50) adjacent to the electrode hanger bar and in the edge (5, 24, 44) opposite to the hanger bar, there is by extrusion formed an edge strip (11, 12, 13; 29, 32, 33; 48, 51, 52) made of some insulating material to be placed at least partly in the groove.

9. An method according to claim 7, characterized in that both in the edges (4, 6, 30, 31; 49, 50) adjacent to the electrode hanger bar and in the edge (5, 24, 44) opposite to the hanger bar, there is provided an essentially uninterrupted protection made of some insulating material.

10. A method for producing an electrode according to claim 1, characterized in that at least in the groove (7, 25, 45) formed in the edge (5, 24, 44) opposite to the electrode hanger bar, there is formed an edge strip (12, 29, 48) made of some insulating material, to be placed at least partly in the groove, by installing an essentially wedge-shaped edge strip in the groove, and that the groove walls (8, 9; 26, 27; 46, 47) are compressed towards the edge strip in order to make the edge strip stay in place in the groove.

11. A method according to claim 10, characterized in that both in the edges (4, 6; 30, 31; 49, 50) adjacent to the electrode hanger bar and in the edge (5, 24, 44) opposite to the hanger bar, there is formed an edge strip (11, 12, 13; 29, 32, 33; 48, 51, 52) made of some insulating material to be placed at least partly in the groove (7, 25, 45) by installing an essentially wedge-shaped edge strip in the groove, and that the groove walls (8, 9; 26, 27; 46, 47) are compressed towards the edge strip in order to make the edge strip (11, 12, 13; 29, 32, 33; 48, 51, 52) stay in place in the groove.

12. An method according to claim 10, characterized in that both in the edges (4, 6, 30, 31; 49, 50) adjacent to the electrode hanger bar and in the edge (5, 24, 44) opposite to the hanger bar, there is provided an essentially uninterrupted protection made of some insulating material.

* * * * *